United States Patent [19]

Sabatka

[11] Patent Number: 4,931,109

[45] Date of Patent: Jun. 5, 1990

[54] METHOD AND APPARATUS FOR DEPOSITING AN INORGANIC PHOSPHATE COATING

[75] Inventor: Winston E. Sabatka, Lakeville, Minn.

[73] Assignee: Finishing Equipment, Inc., St. Paul, Minn.

[21] Appl. No.: 230,751

[22] Filed: Aug. 10, 1988

Related U.S. Application Data

[63] Continuation-in-part of Ser. No. 95,739, Sep. 11, 1987, abandoned.

[51] Int. Cl.[5] ..... C23C 22/03

[52] U.S. Cl. ..... 148/249; 118/423; 118/419; 118/400

[58] Field of Search ..... 148/249; 118/412, 428, 118/419, 400

[56] References Cited

U.S. PATENT DOCUMENTS

| | | | |
|---|---|---|---|
| 2,519,934 | 7/1950 | Verner et al. | 148/6.15 |
| 2,857,298 | 10/1958 | Smith | 148/6.17 |
| 3,249,471 | 5/1966 | Higgins et al. | 148/6.15 |
| 3,524,749 | 8/1970 | Parker et al. | 106/14 |
| 4,008,101 | 2/1977 | Rowe, Jr. et al. | 148/6.15 |
| 4,029,523 | 6/1977 | Rowe, Jr. et al. | 148/6.17 |
| 4,070,521 | 1/1978 | Rowe, Jr. et al. | 428/332 |
| 4,102,710 | 7/1978 | Rowe, Jr. et al. | 148/6.15 |
| 4,118,253 | 10/1978 | Rowe, Jr. et al. | 148/6.15 |

*Primary Examiner*—Sam Silverberg

*Attorney, Agent, or Firm*—Kinney & Lange

[57] ABSTRACT

A method and an apparatus for depositing an inorganic phosphate coating on a metal substrate includes providing a first composition in a first bath having a high water and a high alcohol content and providing a second composition in a second bath having a low alcohol content positioned in proximity to the first bath so that vapors from the second bath are commingled with vapors from the first bath and the alcohol content of the second bath being such that the commingled vapors have an alcohol content that is not flammable.

13 Claims, 1 Drawing Sheet

METHOD AND APPARATUS FOR DEPOSITING AN INORGANIC PHOSPHATE COATING

REFERENCE TO CO-PENDING APPLICATION

This application is a continuation-in-part of pending application Ser. No. 07/095,739 filed on Sept. 11, 1987 now abandoned.

FIELD OF THE INVENTION.

This invention is directed to a process for depositing an inorganic phosphate coating in a substrate using a high water and high alcohol content in a phosphatizing bath and a vapor zone associated with the bath that is not flammable.

DESCRIPTION OF THE PRIOR ART.

Phosphate coatings are widely employed in the metal finishing industry for reducing corrosion and improving adhesion of topcoats, primers and paints on metal surfaces. Typically, either iron phosphate or zinc phosphate coatings are used, with the choice being determined largely by the end use of the metal article. Articles intended for interior use under controlled environments are generally treated with iron phosphate coatings, while those to be subjected to severe use under hostile environments are usually zinc phosphate coated.

Currently, a variety of solvent-based iron phosphatizing processes are available. For example, U.S. Pat. No. 3,524,749, assigned to DuPont, discloses compositions containing at least 85% by volume of a chlorinated hydrocarbon solvent, such as trichlorethylene or perchlorethylene, between 5 ppm and 5% by volume of phosphoric acid, and from 2%–10% by volume of a $C_{3-8}$ alcohol as a solubilizer.

U.S. Pat. No. 4,008,101, assigned to Diamond-Shamrock Corporation of Cleveland, Ohio, provides solvent-based iron phosphatizing compositions which contain methylene chloride, a phosphatizing amount of phosphoric acid and a solubilizing solvent, usually an alcohol having less than 6 carbon atoms, capable of solubilizing phosphoric acid in methylene chloride. That iron phosphating composition further contains water in excess of the amount of phosphoric acid, such that the composition maintains liquid phase homogeneity.

U.S. Pat. No. 4,102,710, also assigned to Diamond-Shamrock, is directed to solvent-based iron phosphatizing compositions similar to those of U.S. Pat. No. 4,008,101, additionally containing phenolic stabilizers to further enhance the substantial water insolubility of the phosphate coatings and to assure topcoat adhesion.

U.S. Pat. No. 4,118,253, assigned to Diamond-Shamrock, discloses an iron phosphatizing composition wherein the relative amounts of the halogenated organic solvent, phosphoric acid solubilizer, phosphoric acid and water are so selected that the composition maintains a continuous, homogeneous liquid phase and is non-flammable.

U.S. Pat. No. 4,029,523, assigned to Diamond-Shamrock, discloses a liquid phosphatizing composition containing organic solvent, such as 1,1,1-trichlorethane or trichlorofluoromethane, a phosphatizing proportion of phosphoric acid, a solubilizing liquid capable of solubilizing phosphoric acid in the organic solvent, and water in an amount exceeding the proportion of phosphoric acid. The iron phosphatized coatings deposited onto metal surfaces from solvent-based compositions such as those disclosed in the above-cited patents assigned to DuPont and to Diamond-Shamrock, are all said to demonstrate at least substantial water insolubility, a degree of corrosion resistance over untreated metal and provide a surface for adhesion of paint or other finish coatings.

SUMMARY OF THE INVENTION

A method and an apparatus for depositing an inorganic phosphate coating on a metal substrate includes providing a first composition in a first phosphatizing bath having a high alcohol content and a second composition in a second bath having a low alcohol content.

The first composition includes a halohydrocarbon, solubilizing solvent alcohol capable of solubilizing phosphoric acid in the halohydrocarbon and present in the composition in an amount between 25 volume percent and a level corresponding to the flammable concentration of the alcohol, and water in an amount exceeding the proportion of phosphoric acid, while being sufficient for the composition to form on the metal substrate a phosphate coating of substantial water insolubility and while retaining continuous liquid phase homogeneity. If a zinc phosphate coating is desired, then zinc in an amount sufficient to saturate the composition is added.

The second composition includes a level of alcohol such that when the vapor from the second composition is commingled with vapor from the first composition, the commingled vapor is not flammable.

The metal substrate is immersed in the first composition in the first bath for formation of the phosphate coating on the substrate and then removed from the first bath and held in the commingled vapors of the first and second composition until substantially all liquid on the substrate has evaporated.

DETAILED DESCRIPTION OF THE PREFERRED EMBODIMENTS

Figure 1:
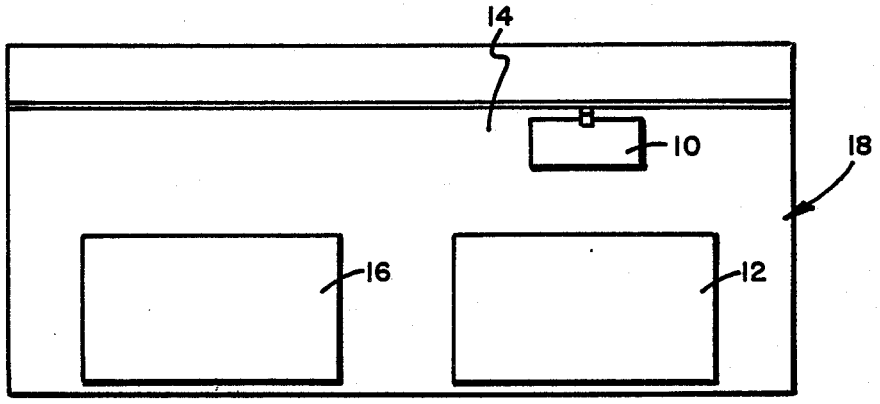
FIG. 1 is a diagrammatical view of an apparatus of the present invention.

The present invention includes both a method for and an apparatus useful for depositing onto metal an inorganic zinc or iron phosphate coating. Using the present invention, a rapid deposition of a heavy, high-quality, fine-grain phosphate coating is formed on the metal.

High levels of a solubilizing alcohol are needed to promote heavy deposition of phosphate coatings on to the metal. However, high levels of alcohol in the coating composition can produce a vapor zone having a flammable concentration of the alcohol. Such a danger can exist even though the coating composition initially is at a temperature and concentration that will not produce a vapor zone having a flammable concentration of alcohol, since there is always the risk that the temperature control of the coating composition may not be accurate or get out of control due to operator inattentiveness or instrument failure.

As illustrated in FIG. 1, in depositing a phosphate coating on to a metal object 10, the metal object is immersed in a coating composition in a phosphatizing bath 12 for forming the phosphate coating on the object. After the desired thickness of coating has been deposited on the object 10, the object is removed from the coating composition and held in a vapor zone 14. Any liquid from the coating composition that is attached to the metal object is permitted to evaporate in the vapor zone 14. After evaporation, the metal object is in a dry condition ready for the deposition of additional top coats, such as primers or paints. Liquid condensed from the vapor zone is returned to the phosphatizing bath with complete retention of homogeneity in the phosphatizing composition.

The present invention eliminates the problem of a flammable alcohol concentration in the vapor zone. In a second bath 16, a second composition is provided whose vapor, when commingled with the vapor from the phosphatizing composition of the first bath 12, lowers the alcohol concentration in the vapor zone to a level that is not flammable. The second bath can be for the express purpose of providing such a vapor or the second bath can be a pre-clean bath or a rinse bath in which the object is immersed prior to bath 12.

An important consideration in the present invention is the second bath containing the composition with the lower alcohol content must be situated such that the vapors from the second bath are commingled with the vapors from the first bath. This may be done in a number of ways, the specific manner not being important. One exemplary manner in which the two baths are associated is that they are positioned in an enclosure 18 as illustrated in FIG. 1 so that the vapors from both baths form the vapor zone 14. Generally, the alcohol content of the second bath is less than 15 volume percent.

The phosphatizing composition of the present invention includes a significantly high water content and a significantly high alcohol content. The combination of a high water content along with a high alcohol content provides a heavy, high quality, fine grain phosphate coating on to the metal. Preferably, the phosphate coating is a zinc phosphate coating. However, an iron phosphate coating can be produced just as well using the method and the apparatus of the present invention.

The phosphatizing composition of the present invention includes a halohydrocarbon, a solubilizing solvent alcohol capable of solubilizing phosphoric acid in the halohydrocarbon and present in the composition in an amount between about 25 volume percent and a level corresponding to the flammable concentration of the alcohol, a phosphatizing portion of phosphoric acid, and water in an amount exceeding the proportion of phosphoric acid while being sufficient for the composition to deposit on metal a zinc or iron phosphate coating of substantial water insolubility and while retaining continuous liquid phase homogeneity of the composition. Zinc is added in an amount sufficient to saturate the composition if a zinc phosphate coating is desired. If an iron phosphate coating is desired, the composition will react with the ferruginous substrate to form an iron phosphate coating.

The halohydrocarbon constituent of the present invention is present in an amount between about 10–50 volume percent of the composition. Preferably, the halohydrocarbon is trichlorotrifluoroethane. Freon® TF, from E. I. DuPont de Nemours & Company of Wilmington, De., is preferred because it is readily commercially available, although other forms of trichlorotrifluoroethane may also be used with desirable results. Freon® TFS, available from E. I. DuPont & Company, has also been successfully used, as it contains a stabilizing amount of nitromethane (approximately 2.7 volume percent) which is believed to contribute to the rapid deposition of a heavy high quality fine-grained zinc phosphate coating of consistent water insolubility.

Methylene chloride can also be used effectively in the present composition. In addition, 1,1,1-trichlorethane, trichloroethylene, and perchloroethylene may be used with suitable alcohols. The halohydrocarbon will typically provide between 10–50 volume percent of the phosphatizing composition, and thus does not constitute a major liquid component thereof. Preferably, the halohydrocarbon is present in an amount between 15–40 volume percent of the total solution.

The solvent for solubilizing phosphoric acid in the halohydrocarbon is selected from alcohols having 8 carbons or less. For efficiency and economy, isopropanol is the presently preferred solvent, since it is readily commercially available at relatively low cost and demonstrates a capability of solubilizing a high amount of water in Freon® TFS, the presently preferred halohydrocarbon. An amount of isopropanol in the range of 25–60 volume percent is preferred.

Other alcohols such as ethanol and methanol may also be used. It is possible for alcohols of more than 8 carbons to be present in a minor amount, but they should not constitute the major amount of the solvent in the total phosphatizing composition. The solvent may be a single alcohol from among those just described or may be a mixture of such suitable alcohols. The solvent also facilitates the solubility of water in the phosphatizing composition, so that the composition as a whole forms a continuous phase homogeneous solution. Since the phosphoric acid solubilizing solvent is also present in the vapor of the rinse zone, it contributes to removing phosphoric acid from the phosphate coated article suspended in the vapor zone after the phosphatizing treatment.

Since phosphoric acid has only a limited solubility in the halohydrocarbon component, this problem is overcome by the use of the aforementioned solubilizing solvent. Phosphoric acid need only be present in a minor phosphatizing amount, but because of the effect of the solubilizing solvent, it may optionally be present in substantial amount. Generally, an amount of phosphoric acid in the range of between 0.10–0.5 volume percent is sufficient for depositing an efficient and economical phosphate coating. The larger amounts of phosphoric acid may have a tendency to deposit a noticably sticky phosphate coating, which is generally considered undesirable, particularly if additional topcoatings, paints or primers are to be subsequently applied to the coated article.

The term "phosphoric acid", as used herein, is intended to refer to any of the substances which are generally used in the phosphatizing art for the deposition of a phosphate coating onto metal substrates. Typically phosphoric acid is generally used, with orthophosphoric acid preferred for economic considerations. However, any source of phosphate ion combined with a source of hydrogen ion is within the scope of the present invention and including both organic phosphates and inorganic phosphates.

Iron and iron containing ferruginous metals generally recognized as susceptible to phosphatizing may be advantageously coated by the present phosphatizing composition. Other non-ferruginous metals capable of reacting with phosphoric acid, such as zinc, aluminum, and galvanized steel may also be phosphatized according to the present invention.

Water is always present in the composition in significantly high amount and in substantial excess of the amount of the phosphoric acid, yet in an amount sufficient to allow the composition as a whole to retain continuous single phase homogeneity. Water must also be present in an amount sufficient to provide a phosphate coating of substantial water insolubility on the metal substrate. The amount of water present cannot be such as to destroy the liquid phase homogeneity of the composition as a whole. If the water component is allowed to separate, phosphoric acid will have a tendency to be preferentially solubilized into the water phase, destroying the phosphating effectiveness of the composition. Water will thus preferably be present in an amount between 6–10 percent by volume.

According to the present invention, the deposition of the phosphate coating requires the presence of zinc in the phosphatizing composition if a zinc phosphate coating is desired. The zinc component can be supplied to the composition in a variety of acceptable forms. Elemental zinc, zinc salts or zinc cation-contributing compounds have all been found to be suitable and are added in an amount to provide a composition saturated with zinc. Since the solubility of zinc in the phosphatizing composition is low, a slight excess of undissolved zinc or zinc salts is preferably present to assure that the phosphatizing composition remains saturated with zinc. Zinc phosphate is the preferred form for introducing zinc into the composition, and has the additional advantage of permitting a slightly smaller amount of phosphoric acid to be used in the composition. Zinc oxide powder may be added directly to the bath. In addition, the bath may be circulated through a filter containing zinc oxide. Zinc may, of course, be added to phosphoric acid to produce zinc phosphate. Generally, the amount of zinc added to the phosphatizing composition will be in the range of between about 0.1–1.0 volume percent of the total composition.

If an iron phosphate coating is desired, the zinc is left out of the phosphatizing composition. The iron on the metal part to be phosphatized reacts with the phosphatizing composition to produce an iron phosphate coating.

Another component which may be present in the phosphatizing composition is nitromethane. Nitromethane may be present in amounts ranging from 1–5% without difficulty. Nitromethane evaporates quite readily and does not interfere with subsequent topcoats that may be applied to the coated metal.

The metal articles to be phosphatized according to the present invention may be suitably first degreased in a degreasing solution based on the present halohydrocarbons. One suitable degreasing solution includes approximately 89% Freon® (TFS), 10% isopropyl alcohol and 1% water. Degreasing is performed by immersion of the article in the liquid solvent, holding the article in a vapor from the solution or spraying of the solution on the article.

Immediately following the degreasing, the metal articles are immersed in the phosphatizing composition bath, preferably maintained at the boiling temperature (112° F.–116° F). Upon removal from the bath, the phosphatized article is rinsed and then held suspended in the vapor zone created above the phosphatizing bath to evaporate the volatile constituents from the coated article to coating dryness. The coating is insoluble in water after 2–3 minutes of drying in air.

The vapor zone occupies the atmosphere adjacent to the surface of the phosphatizing bath and its composition will generally be the composition of vapors from the phosphatizing composition commingled with vapors from other baths such as degreasing.

Prior to the phosphatizing, the metal article may be precleaned by spraying or immersion in a bath comprised of the condensation products of the vapor zone. Also, the metal article can be rinsed after contacting with the phosphatizing bath in a rinse solution comprised of condensed vapor from the phosphatizing bath vapor zone. To insure speed, efficiency and completeness of operation in all treatments, the phosphatizing composition is maintained at the boiling point throughout, although lower temperatures are contemplated. At the normal atmospheric conditions maintained throughout all of these procedures, the boiling point of the phosphatizing composition will be generally within the range of between 108° F.–115° F.

During phosphatizing, the vapor zone generally contains halohydrocarbon vapor, vapor from the solubilizing solvent alcohol, both as described previously hereinabove, water vapor, and in addition trace amounts of other substances. Since these components are the main constituents of the vapor zone, they are also the main constituents of the phosphatizing composition which will generally be depleted from the composition through evaporation. In order to compensate for this loss, the replenishing liquids for the phosphatizing composition are formulated to contain halohydrocarbon, solubilizing solvent alcohol, both as described herein, and water. These replenishing liquids can be used for sustaining the phosphatizing bath composition and form a single phase, homogeneous and storage-stable blend. These replenishing or sustaining blends can be prepared and then stored or shipped for subsequent use in maintaining the required volume and composition of the present solvent-based zinc phosphatizing composition.

In preparing the replenishing or sustaining solution, the halohydrocarbon generally will be present in between 87–92 volume percent of the total solution. The solubilizing solvent alcohol will usually be present in an amount between about 5–20 volume percent of the total solution. Water will be present in high percentage, generally in the range of between 0.01–3.0 volume percent of the total solution. The relative amounts of halohydrocarbon, solubilizing solvent alcohol and water are selected always to insure single phase solution homogeneity. For the preferred solubilizing solvent, isopropanol, and the preferred halohydrocarbon, Freon® TFS, the replenishing solution will contain preferably between about 20–90 volume percent Freon® TFS, between about 5–20 volume percent isopropanol, and between about 0.01–3.0 volume percent water, with these three components totalling 100 volume percent of a single phase homogeneous replenishing solution.

To optimize the phosphatizing operation, the relative amounts of halohydrocarbon, solubilizing solvent alcohol and water in the replenishing solution will be essentially the same as that of the phosphatizing composition vapor zone. To obtain an essentially homogeneous replenishing solution, water and the solubilizing solvent alcohol are first admixed with each other, and then the halohydrocarbon is added quickly to retain the single phase homogeneity of the total solution.

When the preferred halohydrocarbon, Freon®TFS, and the preferred solubilizing solvent alcohol, isopropanol, are employed, the most efficient zinc phosphate coating action will be obtained when the replenishing solution is added to the phosphatizing composition so as to maintain the phosphatizing bath at a specific gravity between about 1.09–1.15 at 100° F.

The replenishing solution, in addition to maintaining and replenishing the volume of the phosphatizing composition, can be used in preparing fresh phosphatizing composition. In preparing a typical fresh phosphatizing composition, the replenishing solution is added together with isopropanol, water and orthophosphoric acid (85%). First, alcohol is added to the replenishing solution and then water. The phosphoric acid is added last.

After the phosphate coating has formed on the metal article, the article is suspended in the vapor zone created by vaporized components of the phosphatizing composition. The chief constituents of the vapor zone will be the halohydrocarbon, solubilizing solvent alcohol and water. The vapor zone provides a suitable medium for drying of the phosphate coated articles. In an immersion type of phosphatizing operation, the coated article will generally be removed from the phosphatizing bath to the vapor zone, rinsed and then suspended in the vapor zone until dry and then removed for subsequent operations, such as the application of topcoatings, paints or primers.

As has been mentioned previously herein, the constituents of the vapor zone will, upon condensation, form a single phase homogeneous solution. This obviously enhances the simplicity of operation of recirculating systems, especially when the coating operation is carried out in a conventional degreaser apparatus. Such recirculating systems can be designed to permit additional replenishing solution to be added continuously as needed to the condensed vapor to continuously maintain the phosphatizing composition bath.

Since the phosphatizing composition will be typically maintained at the boiling temperature, the temperature of the vapor zone will normally be within the range of between 105° F.–115° F. The composition of the vapor zone will generally comprise the halohydrocarbon present in an amount of between 20–90 volume percent, the solubilizing solvent alcohol present in an amount of between 5–20 volume percent and water present in an amount of between 0.01–3.0 volume percent, totaling 100 volume percent.

According to this invention, the phosphatizing composition will provide a desirable phosphate coating having a weight of between about 50–300 mg per square foot. A coating of 100 mg per square foot can be formed in 30–70 seconds. The amount of zinc present in a zinc phosphate coating will generally be within the range of between about 0.1–15 volume percent. Typical contact times for the metal article with the phosphatizing composition can be between about 1–6 minutes. These coatings are produced readily and consistently and with desirable coating uniformity. Very rapid phosphatizing bath contact times are noted and a fine grained zinc or iron phosphate coated article results.

The phosphate coatings produced according to this invention demonstrate remarkable water resistance. Tests of a zinc phosphate coating were conducted involving continuous exposure of a sample metal surface to salt spray. (ASTM B-117 at 100° F. with a 5% salt solution.) Steel surfaces which were zinc phosphate coated according to this invention and then coated with a white epoxy paint demonstrated remarkable resistance for up to 240 hours. By contrast, unphosphated steel surfaces coated with the same white epoxy paint exhibited significant corrosion after only 24 hours, and steel surfaces which were iron phosphate coated according to a conventional solvent-based iron phosphatizing process and then coated with the same white epoxy paint exhibited significant corrosion after only 168 hours.

Cleaning and degreasing of the metal surface prior to application of the present phosphate coating is considered advisable. Conventional degreasing systems with known degreasing solutions may, of course, be used, but preferably degreasing can be carried out using Freon® TFS or the replenishing solution having the same composition as the condensed zinc phosphatizing vapor.

The following examples are provided for illustrative purposes only and are not intended to limit the present invention in any way.

EXAMPLE

A zinc phosphate coating was formed on a cold rolled steel sample panel using an open top, two bath machines marketed under the trademark De-GREESPHOS by Finishing Equipment, Inc., of St. Paul, Minn. The machine contains a phosphatizing bath and a rinse bath.

The composition of the phosphatizing bath is approximately 10 volume percent water, 34 volume percent Freon® TF from E. I. DuPont de Nemours & Company of Wilmington, De., 56 volume percent isopropanol and zinc at the saturation point of the solution. The specific gravity of the solution was 1.050 at 96° F.

The rinse bath contained approximately 0.3 volume percent water, 86.2 volume percent Freon® TF and 12.4 volume percent isopropanol.

The panel was precleaned by holding the panel and the vapor zone above the baths. The panel was then immersed in the phosphatizing bath whose temperature was maintained approximately at or near its boiling point. The panel was immersed for 60 seconds in the phosphatizing bath.

After phosphatizing, the panel was held in the vapor zone for 15 seconds and then rinsed in the rinse bath for 15 more seconds. After the rinse bath, the panel was held in the vapor zone for 15 seconds to dry. The coated weight on the panel was 200.7 mg/sq. FT. of coating and the zinc content was 0.28 weight percent. The water solubility of the coating was zero, that is the panel lost no weight at all upon soaking in water.

Similar results were also achieved by spraying the phosphate solution on to the panel, except coating weights obtained are generally heavier and reaction time is less when the phosphatizing composition is sprayed on to the panel.

Although the present invention has been described with reference to preferred embodiments, workers skilled in the art will recognize that changes may be made in form and detail without departing from the spirit and scope of the invention.

What is claimed is:

1. An apparatus for coating a metal substrate with an inorganic phosphate coating, the apparatus comprising:

a first bath containing a first composition in which the metal substrate is immersed for formation of the phosphate coating on the substrate, the first composition including a halohydrocarbon, a solubilizing solvent alcohol capable of solubilizing phosphoric acid in the halohydrocarbon and present in the composition in an amount between 25 volume percent and a level corresponding to the flammable concentration of the alcohol, a phosphatizing proportion of phosphoric acid, and water in an amount exceeding a portion of phosphoric acid, while being sufficient for the composition to deposit on the metal substrate a phosphate coating of substantial water insolubility while retaining continuous liquid phase homogeneity; and a second bath containing a second composition, the second bath situated such that vapors from the second composition are commingled with vapors of the first composition forming a vapor zone, the second composition including a level of alcohol such that vapors produced from the second composition when commingled with the vapors from the first composition produce a vapor with an alcohol content that is not flammable.

2. The apparatus of claim 1 wherein the halohydrocarbon is trichlorotrifluoroethane.

3. The apparatus of claim 1 wherein the solubilizing solvent alcohol is isopropanol.

4. The apparatus of claim 1 wherein zinc is present in the first bath.

5. The apparatus of claim 4 wherein the zinc is present in the form of elemental zinc, zinc salts, or cation-contributing compounds.

6. A process for depositing a phosphate coating, the process comprising: contacting a metal substrate with a first liquid composition comprising a halohydrocarbon, a solubilizing solvent alcohol capable of solubilizing the phosphoric acid in the halohydrocarbon and present in the composition in an amount between 25 volume percent and a level corresponding to the flammable concentration of the alcohol, a phosphatizing proportion of phosphoric acid, and water in an amount exceeding the proportion of phosphoric acid, while being sufficient for the composition to deposit on the metal substrate a phosphate coating of substantial water insolubility while retaining continuous liquid phase homogeneity; and providing a second liquid composition in proximity to the first liquid composition so that vapors from the second composition are commingled with vapors from the first composition, the second composition including a level of alcohol so that the vapors from the second composition when commingled with vapors from the first composition produce a vapor having an alcohol content that is not flammable.

7. The process of claim 6 wherein the halohydrocarbon is trichlorotrifluoroethane.

8. The process of claim 6 wherein the solubilizing solvent alcohol is isopropanol.

9. The process of claim 6 wherein the zinc is present in the first bath.

10. The process of claim 9 wherein the zinc is in the form of elemental zinc, zinc salts or zinc cation-contributing compounds.

11. The process of claim 6 wherein the second liquid composition has no more than 15 percent alcohol.

12. The process of claim 11 wherein the second liquid composition is a degreasing composition.

13. The process of claim 11 wherein the second liquid composition is used as a rinse.

* * * * *